US011697036B2

(12) United States Patent
Yazdi et al.

(10) Patent No.: US 11,697,036 B2
(45) Date of Patent: Jul. 11, 2023

(54) UNPOWERED RESPIRATORY PROTECTIVE HEADSET AND BODY SUIT AND ADDITIONAL IMPROVEMENTS TO PERSONAL PROTECTIVE EQUIPMENT

(71) Applicant: The Johns Hopkins University, Baltimore, MD (US)

(72) Inventors: Youseph Yazdi, Baltimore, MD (US); Matthew Petney, Baltimore, MD (US); William A. L. Patterson, Baltimore, MD (US); Laura Scavo, Baltimore, MD (US); Patience Osei, Baltimore, MD (US)

(73) Assignee: The Johns Hopkins University, Baltimore, MD (US)

( * ) Notice: Subject to any disclaimer, the term of this patent is extended or adjusted under 35 U.S.C. 154(b) by 204 days.

(21) Appl. No.: 16/869,131

(22) Filed: May 7, 2020

(65) Prior Publication Data

US 2021/0077837 A1 Mar. 18, 2021

Related U.S. Application Data

(63) Continuation of application No. 15/052,298, filed on Feb. 24, 2016, now abandoned.

(Continued)

(51) Int. Cl.

| | |
|---|---|
| ***A62B 17/04*** | (2006.01) |
| ***A62B 18/02*** | (2006.01) |
| ***A62B 18/08*** | (2006.01) |

(52) U.S. Cl.

CPC ..... *A62B 17/04* (2013.01); *A62B 18/025* (2013.01); *A62B 18/082* (2013.01)

(58) Field of Classification Search

CPC ..... A62B 17/04; A62B 17/006; A62B 18/084; A62B 18/025; A62B 18/082; A62B 18/10;

(Continued)

(56) References Cited

U.S. PATENT DOCUMENTS

| | | | | |
|---|---|---|---|---|
| 4,932,078 A | | 6/1990 | Jones et al. | |
| 5,140,980 A | * | 8/1992 | Haughey ..... | A62B 17/04 D24/110.3 |

(Continued)

FOREIGN PATENT DOCUMENTS

| | | |
|---|---|---|
| EP | 0771577 A1 | 5/1997 |
| GB | 2367755 A | 4/2002 |

*Primary Examiner* — Joseph D. Boecker
*Assistant Examiner* — Brian T Khong
(74) *Attorney, Agent, or Firm* — Venable LLP; Henry J. Daley

(57) ABSTRACT

An unpowered respiratory protective headset for personal protective equipment and personal protective bodysuits with an unpowered respiratory protective headset, the unpowered respiratory protective headset having a respiratory mask having a flexible mask body having an interface section and defining a mask air inlet and a mask air outlet, an inhalation valve in the mask air inlet and an exhalation valve in the mask air outlet, and a hood having a hood body and a transparent face shield attached to the hood body. The hood has an air inlet and an air outlet and the air inlet, the mask air inlet, the mask air outlet and the air outlet are configured relative to each other to direct air flow across an inner surface of the transparent face shield to prevent or reduce fogging of the transparent face shield during inhalation and exhalation by a subject.

18 Claims, 15 Drawing Sheets

Related U.S. Application Data

(60) Provisional application No. 62/120,105, filed on Feb. 24, 2015.

(58) Field of Classification Search
CPC ..... A62B 18/045; A62B 18/04; A62B 18/08; A62B 18/00; A62B 27/00; A62B 23/02; A62B 23/025; A62B 9/04; A62B 7/10; A41D 13/1153; A41D 13/1218; A41D 27/28
See application file for complete search history.

(56) References Cited

U.S. PATENT DOCUMENTS 5,549,104 A 8/1996 Crump et al.
5,924,420 A * 7/1999 Reischel ..... A62B 18/082 128/206.28
6,158,429 A * 12/2000 Gardner ..... A62B 17/04 128/201.25
6,340,024 B1 1/2002 Brookman et al.
6,701,925 B1 * 3/2004 Resnick ..... A62B 17/04 128/205.27
7,028,688 B1 * 4/2006 Grove ..... A62B 17/04 128/206.17
2002/0023651 A1 2/2002 Japuntich et al.
2002/0092522 A1 * 7/2002 Fabin ..... A62B 17/04 128/205.27
2006/0201511 A1 9/2006 Freriks et al.
2006/0254592 A1 * 11/2006 Anders ..... A62B 18/084 128/206.28
2008/0105255 A1 5/2008 Resnick
2009/0250060 A1 10/2009 Hacke et al.
2011/0023873 A1 2/2011 Walts
2012/0055485 A1 * 3/2012 Anthony ..... A61M 16/0611 128/207.18
2012/0174922 A1 7/2012 Virr et al.
2012/0298104 A1 * 11/2012 Muller ..... A62B 18/084 128/207.11
2016/0008640 A1 * 1/2016 Teetzel ..... A42B 3/228 128/201.19
2016/0129287 A1 * 5/2016 Danford ..... A62B 18/02 128/863

* cited by examiner

UNPOWERED RESPIRATORY PROTECTIVE HEADSET AND BODY SUIT AND ADDITIONAL IMPROVEMENTS TO PERSONAL PROTECTIVE EQUIPMENT

CROSS-REFERENCE OF RELATED APPLICATION

This application claims priority to U.S. Provisional Application No. 62/120,105 filed Feb. 24, 2015, the entire contents of which are hereby incorporated by reference.

BACKGROUND

1. Technical Field

The field of the currently claimed embodiments of this invention relate to unpowered respiratory protective headsets for personal protective equipment and personal protective bodysuits with an unpowered respiratory protective headset.

2. Discussion of Related Art

Head coverings must protect from a range of potential contaminates that may present in a variety of forms: airborne gas or vapors, or aerosol dusts, sprays, mists, smokes, and fumes, or bulk liquid. Health care workers (HCW) treating Ebola, for example, must protect themselves from aerosols that might carry the virus as well as macro splatter or larger volumes of liquids that carry heavy concentrations of the virus. In the most recent Ebola epidemic, HCW elected to use hoods with a separate mask because it was not feasible to use a powered air purifying respirator (PAPR), and the fluid protection granted by the surgical mask was assumed to be sufficient to protect from the Ebola virus.

Hoods that leave the face exposed can be used to protect industrial workers from bulk contamination of chemicals or other material that should not contact the skin. These hoods are paired with other devices such as goggles, full face masks, or face shields to protect the face. As was evident in the response to the 2014 Ebola epidemic mixing and matching multiple products to cover the head can often leave the most sensitive area of the body, the face (eyes, nose, mouth, mucus membranes, etc.) vulnerable to contamination. In use, such as with Ebola, this can lead to the infection of HCW.

Currently, there are two main types of head coverings, or hoods, for personal protective equipment (PPE): 1) head coverings that leave the face exposed, 2) head coverings with integrated face shields that enclose the entire head. Face exposed hoods: Coveralls have an integrated hood that covers the back of the head and lower chin but leaves the face exposed. Standalone hoods also cover the rear of the head but leave the face exposed. If being worn for protection from external contaminants, these hoods require the use of a full face mask, respirator, goggles and/or face shield. Integrated face shield hoods: Fully enclosed suits have an integrated hood with an integrated face shield that fully encloses the head. Similar standalone hoods fully enclose the head and include an integrated face shield. These devices drape loosely over the head. They require an air supply, usually in the form of a powered air purifying respirator (PAPR) to filter incoming air, control levels of carbon dioxide within the hood, and manage fogging of the face shield. The air is either supplied to the inside of the hood or to a full face mask worn underneath the hood.

In the fight against Ebola and countless other medical or industrial applications, a hood is needed that protects the user from exposure without requiring the use of a PAPR.

SUMMARY

Some embodiments of the invention include an unpowered respiratory protective headset for personal protective equipment, comprising a respiratory mask. The respiratory mask comprises a flexible mask body having an interface section and defining a mask air inlet and a mask air outlet. The interface section is of a size, shape and material to form an air-tight seal around a nose and a mouth of a subject when worn. The respiratory mask has an inhalation valve disposed in the mask air inlet and an exhalation valve disposed in the mask air outlet. The headset also comprises a hood comprising a hood body and a transparent face shield attached to the hood body. The hood is of a size and shape to be worn entirely over and enclose cover a subject's head and the respiratory mask while the subject is wearing the respiratory mask within the hood. The hood defines an air inlet and an air outlet spaced apart from the air inlet. The hood further comprises an inlet filter disposed in the air inlet and an outlet valve disposed in the air outlet. The air inlet, mask air inlet, mask air outlet and air outlet are configured relative to each other to direct air flow across an inner surface of said transparent face shield to prevent or reduce fogging of the transparent face shield during inhalation and exhalation by the subject when the unpowered respiratory protective headset is worn. The mask air outlet is attachable to and detachable from said air outlet.

Some embodiments include a personal protective whole-body suit, comprising a body portion and an unpowered respiratory protective headset connectable to said body portion to prevent infectious agents or contaminated air from entering there between. The unpowered respiratory protective headset comprises a respiratory mask. The respiratory mask comprises a flexible mask body having an interface section and defining a mask air inlet and a mask air outlet. The interface section is of a size, shape and material to form an air-tight seal around a nose and a mouth of a subject when worn. The respiratory mask has an inhalation valve disposed in the mask air inlet and an exhalation valve disposed in the mask air outlet. The headset also comprises a hood comprising a hood body and a transparent face shield attached to the hood body. The hood is of a size and shape to be worn entirely over and enclose a subject's head and the respiratory mask while the subject is wearing the respiratory mask within the hood. The hood defines an air inlet and an air outlet spaced apart from the air inlet. The hood further comprises an inlet filter disposed in the air inlet and an outlet valve disposed in the air outlet. The air inlet, mask air inlet, mask air outlet and air outlet are configured relative to each other to direct air flow across an inner surface of said transparent face shield to prevent or reduce fogging of the transparent face shield during inhalation and exhalation by the subject when the unpowered respiratory protective headset is worn. The mask air outlet is attachable to and detachable from said air outlet.

BRIEF DESCRIPTION OF THE DRAWINGS

Further objectives and advantages will become apparent from a consideration of the description, drawings, and examples.

DETAILED DESCRIPTION

Figure 1A:
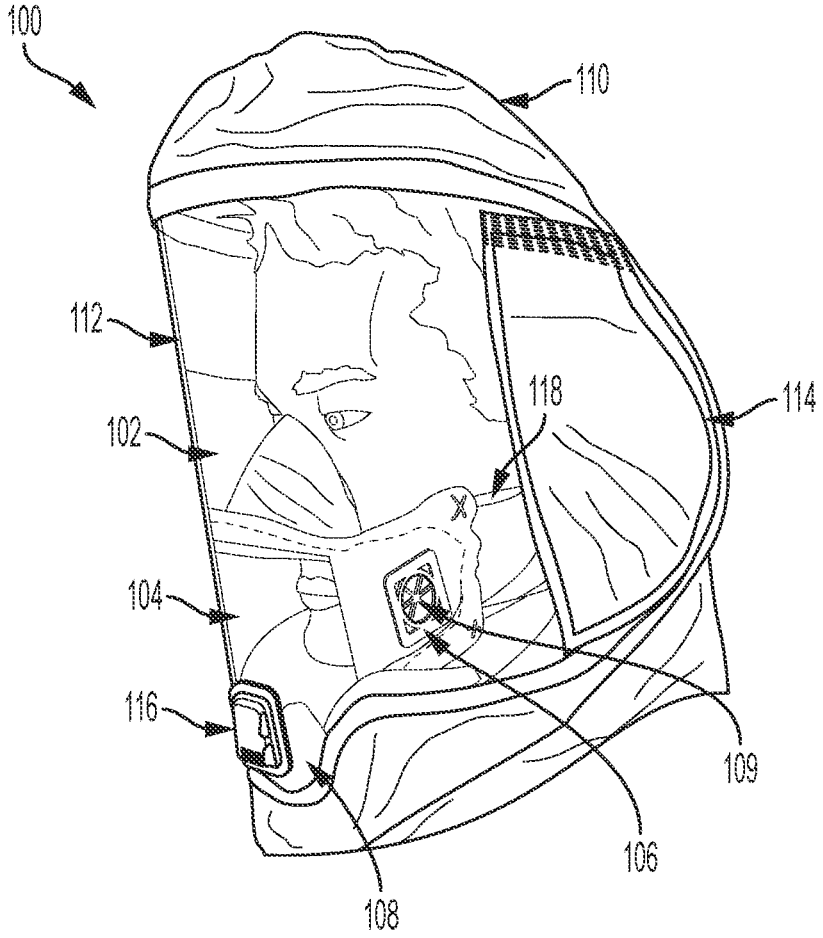
FIG. 1A-1C show images of a headset with a hood, hood body, large transparent face shield and respiratory mask.

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Embodiments of the instant invention include a fully enclosed headset that does not require a powered air supply to protect the face and head of the user from bulk contamination, aerosolized contamination, or airborne contamination. The headset uses a non-rebreathing mask system to pull air in from integrated inhalation valves or inhalation filters during inspiration, and push air out through a separate exhalation pathway during exhalation. This limits the buildup of carbon dioxide gas within the hood, allows the face to be visually unobstructed, decreases the feeling of claustrophobia, and decreases fogging.

Some embodiments of the invention include an unpowered respiratory protective headset for personal protective equipment, comprising a respiratory mask. The respiratory mask comprises a flexible mask body having an interface section and defining a mask air inlet and a mask air outlet. The interface section is of a size, shape and material to form an air-tight seal around a nose and a mouth of a subject when worn. The respiratory mask has an inhalation valve disposed in the mask air inlet and an exhalation valve disposed in the mask air outlet. The headset also comprises a hood comprising a hood body and a transparent face shield attached to the hood body. The hood is of a size and shape to be worn entirely over and enclose a subject's head and the respiratory mask while the subject is wearing the respiratory mask within the hood. The hood defines an air inlet and an air outlet spaced apart from the air inlet. The hood further comprises an inlet filter disposed in the air inlet and an outlet valve disposed in the air outlet. The air inlet, mask air inlet, mask air outlet and air outlet are configured relative to each other to direct air flow across an inner surface of said transparent face shield to prevent or reduce fogging of the transparent face shield during inhalation and exhalation by the subject when the unpowered respiratory protective headset is worn. The mask air outlet is attachable to and detachable from said air outlet.

Some embodiments include a personal protective whole-body suit, comprising a body portion and an unpowered respiratory protective headset connectable to said body portion to prevent infectious agents or contaminated air from entering there between. The unpowered respiratory protective headset comprises a respiratory mask. The respiratory mask comprises a flexible mask body having an interface section and defining a mask air inlet and a mask air outlet. The interface section is of a size, shape and material to form an air-tight seal around a nose and a mouth of a subject when worn. The respiratory mask has an inhalation valve disposed in the mask air inlet and an exhalation valve disposed in the mask air outlet. The headset also comprises a hood comprising a hood body and a transparent face shield attached to the hood body. The hood is of a size and shape to be worn entirely over and enclose a subject's head and the respiratory mask while the subject is wearing the respiratory mask within the hood. The hood defines an air inlet and an air outlet spaced apart from the air inlet. The hood further comprises an inlet filter disposed in the air inlet and an outlet valve disposed in the air outlet. The air inlet, mask air inlet, mask air outlet and air outlet are configured relative to each other to direct air flow across an inner surface of said transparent face shield to prevent or reduce fogging of the transparent face shield during inhalation and exhalation by the subject when the unpowered respiratory protective headset is worn. The mask air outlet is attachable to and detachable from said air outlet.

In some embodiments, the invention relates to the unpowered respiratory protective headset above, wherein the air inlet has an inlet filter with a high surface area further comprising a multilayer configuration of a filter material and an impermeable material.

In some embodiments, the invention relates to the unpowered respiratory protective headset above, wherein the air inlet has an inlet valve.

In some embodiments, the invention relates to the unpowered respiratory protective headset above, wherein the air inlet is disposed on a region corresponding to a top region of said hood.

In some embodiments, the invention relates to the unpowered respiratory protective headset above, further comprising at least two air inlets defined by said hood, wherein said at least two air inlets are disposed on regions corresponding to ear regions of said subject when in use.

In some embodiments, the invention relates to the unpowered respiratory protective headset above, wherein the hood further comprises a water resistant flap disposed over said air inlet.

In some embodiments, the invention relates to the unpowered respiratory protective headset above, wherein the transparent face shield is of dimensions and shape to allow for at least a 120 degree range of view.

In some embodiments, the invention relates to the unpowered respiratory protective headset above, wherein the inhalation valve comprises a one-way valve configured to direct air to flow into an interior space of the respiratory mask.

In some embodiments, the invention relates to the unpowered respiratory protective headset above, wherein the one-way valve comprises a multilayer configuration of a filter material and an impermeable material.

In some embodiments, the invention relates to the unpowered respiratory protective headset above, wherein the exhalation valve comprises a check valve configured to direct air to flow out from an interior space of said respiratory mask.

In some embodiments, the invention relates to the unpowered respiratory protective headset above, wherein the check valve comprises a multilayer configuration of a filter material and an impermeable material.

In some embodiments, the invention relates to the unpowered respiratory protective headset above, wherein the mask air outlet is attachable to and detachable from the air outlet by at least one of an interlocking system or VELCRO™ fasteners, and wherein the interlocking system or VELCRO™ fasteners are configured to create a protected respiratory pathway between the respiratory mask and the hood.

In some embodiments, the invention relates to the unpowered respiratory protective headset above, wherein the interlocking system is a clipping mechanism comprising: a disk disposed onto the air mask outlet; and a receiving end for the disk disposed onto the transparent face shield, wherein the receiving end is configured to allow the disk to slide into the receiving end when attaching said respiratory mask to the hood and to slide out from the receiving end when removing the respiratory mask from the hood.

In some embodiments, the invention relates to the unpowered respiratory protective headset above, wherein the mask air outlet is permanently attached to the air outlet.

In some embodiments, the invention relates to the unpowered respiratory protective headset above, wherein at least a portion of the flexible mask body comprises one or more filter layers.

In some embodiments, the invention relates to the unpowered respiratory protective headset above, wherein at least a portion of the flexible mask body is transparent.

In some embodiments, the invention relates to the unpowered respiratory protective headset above, wherein the respiratory mask further comprises a plurality of straps, the plurality of straps each comprising a first end point and a second end point, wherein the first end point is attached to the flexible mask body at a first attachment point and wherein the second end point is attached to the flexible mask body at a second attachment point.

In some embodiments, the invention relates to the unpowered respiratory protective headset above, wherein the respiratory mask further comprises a plurality of straps, the plurality of straps each comprising a first end point and a second end point, wherein the first end point is attached to the flexible mask body at a first attachment point and wherein the second end point is attached to an interior surface of the hood body at a second attachment point.

In some embodiments, the invention relates to the unpowered respiratory protective headset above, further comprising a circumferential shroud attached to at least a portion of a lower edge of the flexible mask body, and wherein the circumferential shroud prevents air from entering the unpowered respiratory protective headset from a base of the unpowered respiratory protective headset.

In some embodiments of the invention, a large face shield is integrated into the hood to provide a clear view of the user's face and maintain a wide field of view. Although the large face shield can be integral in some embodiments, it can also be attachable and detachable in some embodiments. Inhalation filters, constructed of N95 Respirator and Surgical Mask material (fluid resistant and high filtration quality) are placed along the outside edge of the face mask; these are sewn in place and the seams taped. Alternatively, these inhalation filters are replaced by inhalation valves, constructed of N95 Respirator and Surgical Mask material (fluid resistant and high filtration quality) placed along the outside edge of the face mask; these are sewn in place and the seams taped. During inhalation, the filtered air flows in through the inhalation filters or valves and over the interior surface of the face shield to decrease fogging.

FIG. 1A is an illustration of an unpowered respiratory protective headset 100 for personal protective equipment according to an embodiment of the current invention. The term headset is intended to be a broad term that can include multicomponent equipment such as, but not limited to, a hood body, a face shield, a mask, filters, valves, connectors, straps, bands and/or a collar, for example, as either separate, connected or integral components. The unpowered respiratory protective headset 100 includes a respiratory mask 102 with a flexible mask body 104. The flexible mask body 104 has an interface section and defines a mask air inlet 106, and a mask air outlet 108. The interface section is of a size, shape and material to form an air-tight seal around a nose and a mouth of a subject when worn. An inhalation valve 109 is disposed in the mask air inlet 106 and an exhalation valve is disposed in the mask air outlet 108. The headset also has a hood having a hood body 110 and a transparent face shield 112 attached to the hood body 110. The hood is of a size and shape to be worn entirely over a subject's head and the respiratory mask while the subject is wearing the respiratory mask. The hood is also of sufficient size to enclose the subject's head and the respiratory mask within the hood. The hood also defines an air inlet 114 and an air outlet 116, spaced apart from the air inlet. The hood further has an inlet filter disposed in the air inlet and an outlet filter disposed in the air outlet. In some embodiments, hood further has an inlet valve disposed in the air inlet and an outlet valve disposed in the air outlet. The air inlet, the mask air inlet, the mask air outlet and the air outlet are configured relative to each other to direct air flow across an inner surface of the transparent face shield to prevent or reduce fogging of the transparent face shield during inhalation and exhalation by the subject when the unpowered respiratory protective hood is worn. The mask air outlet is attachable to and detachable from the air outlet. The headset of FIG. 1A also has elastic bands 118 attached to the respiratory mask.

Figure 1B:
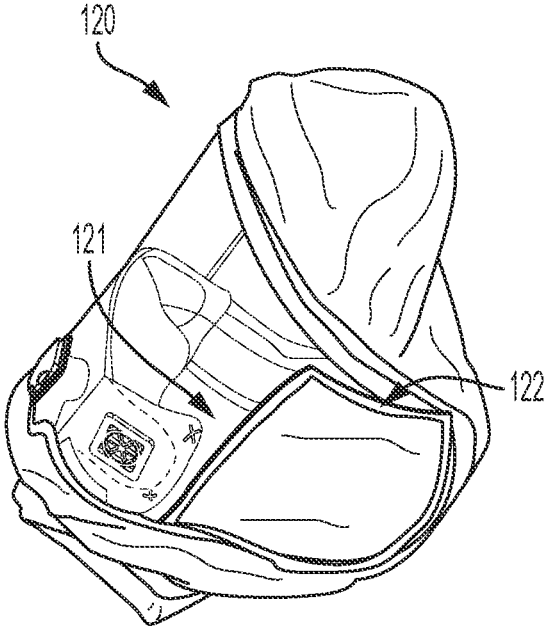
Figure 1C:
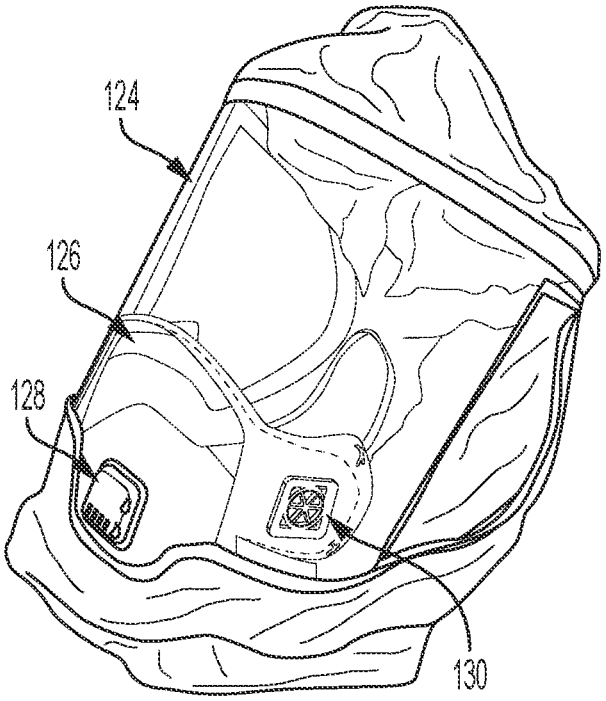

FIG. 1B shows another embodiment of an unpowered respiratory protective headset 120 with an elastic band sewn into the hood to secure the respiratory mask, 121, and an inlet filter 122 positioned on the side of the headset. FIG. 1C shows an embodiment of a headset with a large, clear face shield 124 a visible face mask behind the face shield 126 an inhalation valve positioned on the left side of the respiratory mask 130 and an exhalation valve 128 on the respiratory mask 121.

In some embodiments, the hood body of the unpowered respiratory protective headset above defines the air outlet, and the air outlet does not obstruct a face of said subject when said headset is worn. In other embodiments, the transparent face shield of the headset defines the air outlet, and the air outlet does not obstruct a face of said subject when said headset is worn.

In some embodiments, the air outlet does not obstruct a face of said subject when said headset is worn.

In some embodiments of the invention, the face shield is about 8-11 inches in height and about 12-22 inches in length. Also, the face shield allows for between 180-270 degrees range of vision.

Figure 2A:
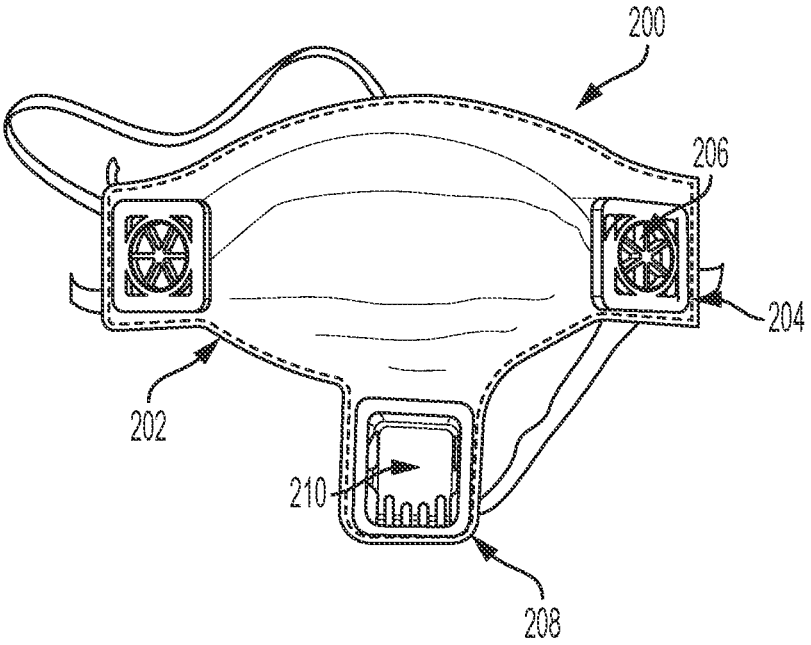
FIG. 2A-2D show images of respiratory masks.
Figure 2B:
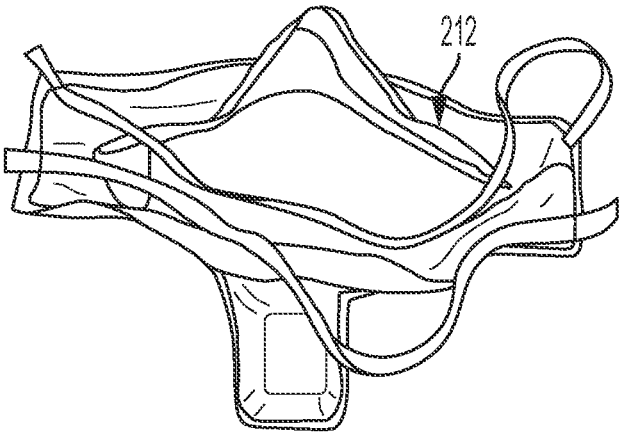
Figure 2C:
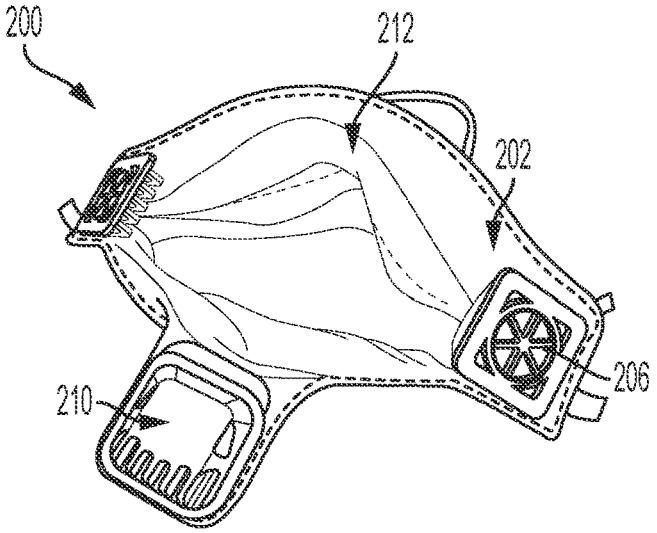
Figure 2D:
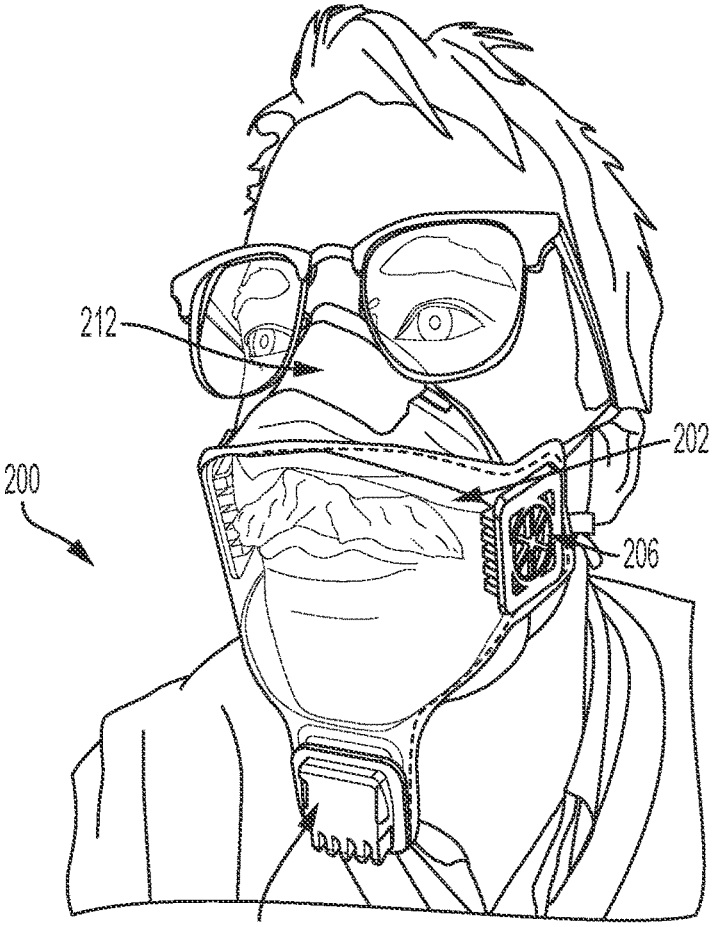

FIG. 2A shows a transparent respiratory mask 200 according to an embodiment of the invention. The transparent respiratory mask 200 comprises a flexible mask body 202 having an interface section and defining a mask air inlet 204 and a mask air outlet 208. The interface section is of a size, shape and material to form an air-tight seal around a nose and a mouth of a subject when worn. An inhalation valve 206 is disposed in the mask air inlet 204 and an exhalation valve 210 is disposed in the mask air outlet 208. In some embodiments, the inhalation valve is a one-way valve and the exhalation valve is a check valve. FIG. 2B shows a respiratory mask with a thin foam strip 212 to stiffen the top flap (nose flap) of the respiratory mask. FIG. 2C and FIG. 2D show alternative views of a transparent respiratory mask.

Figure 3A:
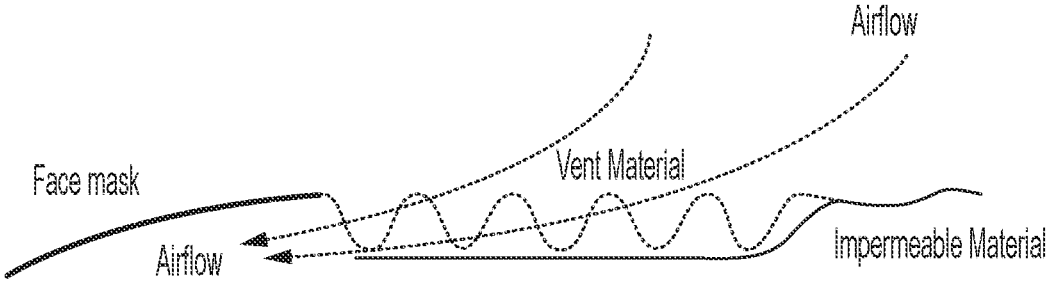
FIG. 3A is a schematic showing a cross-section of valve material as it integrates with the face mask and impermeable material.
Figure 3B:
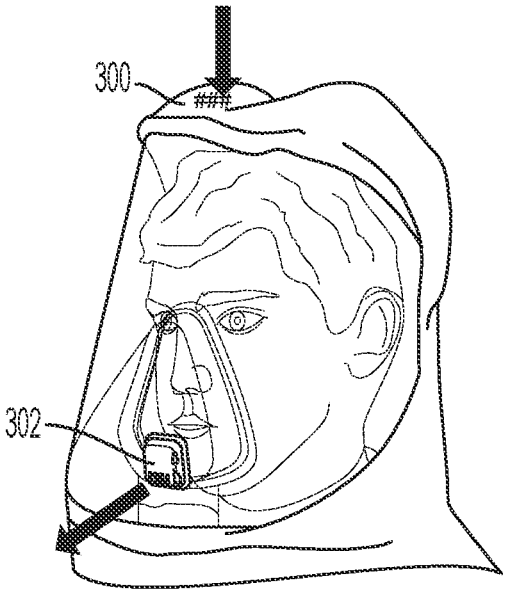
FIG. 3B shows a headset where air flow (depicted by the dark arrows) is directed into the headset at one point, moves across the interior of the transparent face shield, and exits the headset at another point.

In some embodiments, the inhalation valves are constructed to have a semi-rigid form that keeps them from adhering to the surface of the user's head. This form may have a pattern of peaks and troughs arranged so that only a small amount of material can contact the wearer's skin leaving a large surface area available for incoming filtered air to pass through. FIG. 3A is a schematic showing a cross-section of valve material as it integrates with the face mask and impermeable material. In such an embodiment, along the inside of the valve, non-breathable material is used to direct airflow over the mask inner surface. FIG. 3B shows this embodiment when integrated into a headset and body suit. FIG. 3B shows air flow (depicted by the black arrows) directed to enter from air inlet 300. Exhaled air is directed out through a different air outlet 302. These inlets and outlets have a high surface area for air transfer.

Figure 4:
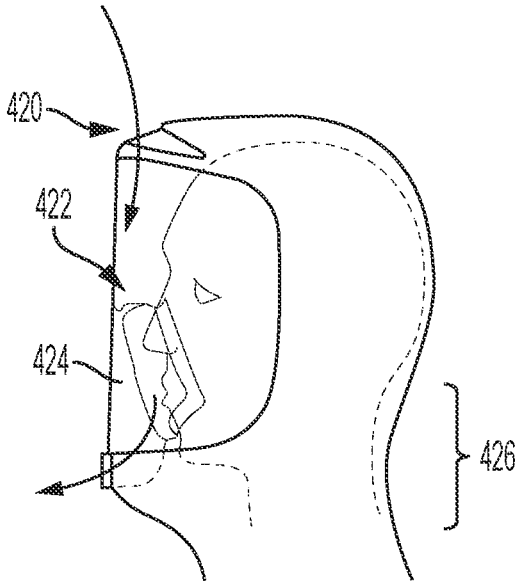
FIG. 4 is an illustration showing a headset where air-flow (depicted by the arrows) is directed into the headset at one point, moves across the interior of the transparent face shield, and exits the headset at another point.

In some embodiments, airflow passes into the space of the hood during inspiration through inlet filters. In some embodiments of the invention, airflow passes into the space of the hood during inspiration through inlet valves. Two oppositely oriented one-way valve systems ensure that air flows into the mask from the hood space, and it flows out through exhalation valves. The mask is a rigid or semi rigid structure with a flexible membrane that creates a seal around the nose and mouth. The flexible membrane allows the mask to fit a variety of face shapes "one size fits all". Although the mask may come in several sizes to accommodate a very wide range of users. The mask is permanently attached to the face shield. The mask is held securely in place on the face of the user by elastic material integrated into the hood. The elastic pulls the edges of the facemask back, thereby applying pressure on the mask (see FIG. 4, which shows an example of a mask that is permanently attached to a face shield). This elastic may be interrupted by a zipper in the hood such that the mask is not pressed onto the face until the zipper is closed. FIG. 4 shows a headset according to one embodiment of the invention. Upon inhalation, air flow (black arrow) is directed to enter through a waterproof valve 420, then through a mask inhalation valve 422 on the clear respiratory mask 424. Exhaled air is directed out of the respiratory mask through an exhalation valve. Tension at the back of the user's head 426 secures the respiratory mask.

Figure 5:
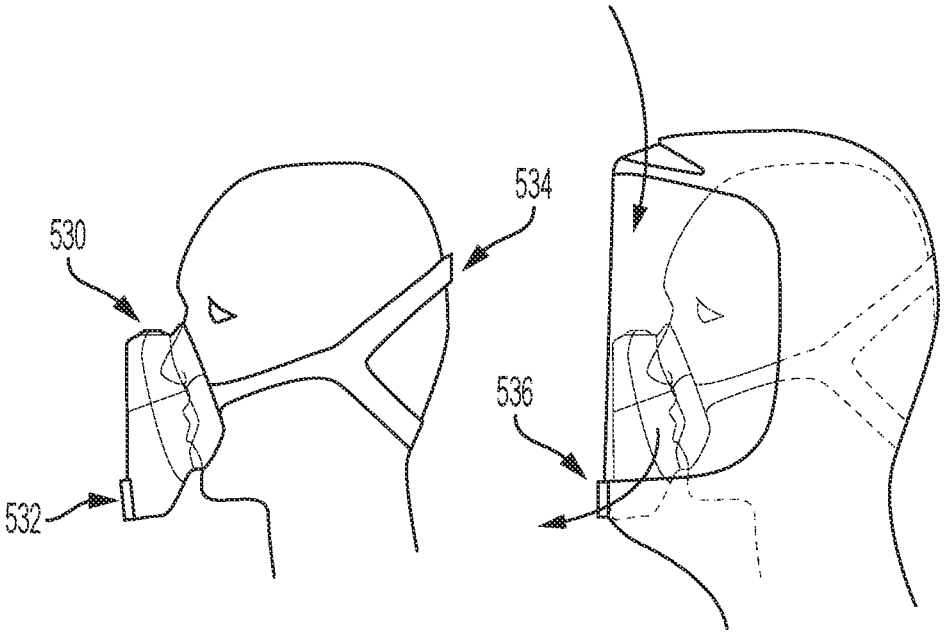
FIG. 5 is an illustration of a respiratory mask (left) and of a headset where air-flow (depicted by the arrows) is directed into the headset at one point, moves across the interior of the transparent face shield, and exits the headset at another point (right).

FIG. 5 shows another embodiment of the respiratory mask. In such an embodiment, the respiratory mask is separate from the hood, and attaches to the face shield during use. In the area of attachment, air is allowed to flow from the respiratory mask out of the hood through an outlet valve in the form of an outlet filter. The respiratory mask has a one-way valve 530 to let inhaled air into the mask. A second one-way valve or check valve 532 directs exhaled air out of the mask. The mask also includes an adjustable band 534 for fitting the mask onto a user's head. VELCRO™ attaches the mask to the hood at the air outlet on the hood 536. Upon inhalation, air flow (black arrow) is directed to enter the headset through a waterproof inlet valve. Exhaled air is directed out of the headset through a waterproof outlet valve.

In some embodiments, the mask covers only the nose, nose and mouth, or the full face. A face shield is integrated into the mask to protect the face while a shroud is not in place. The shroud may alternatively have a flexible window for visibility rather than a rigid face shield.

Figure 6:
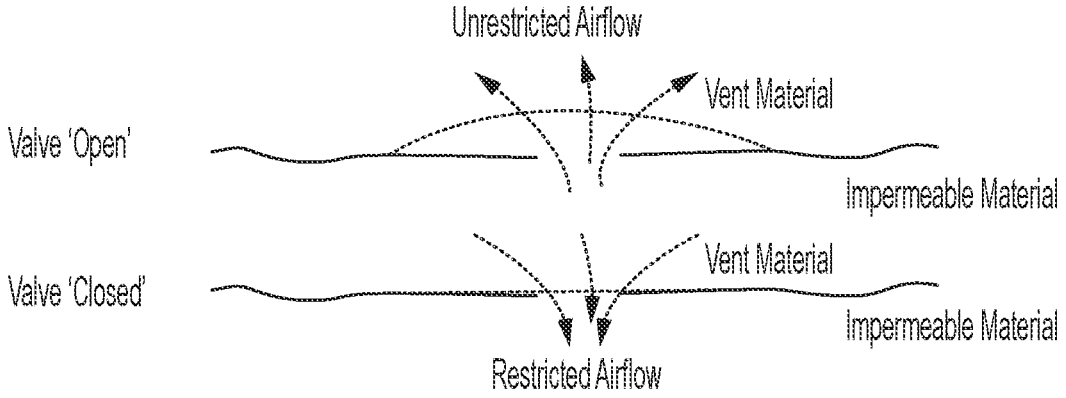
FIG. 6 is a schematic showing a check valve constructed from a bilayer of permeable and impermeable materials.

In some embodiments, the one-way valve systems can be separate pieces, similar to what is commonly used in respirators. These pieces may be replaceable. FIG. 6 shows a schematic of one-way valve systems constructed of a multilayer configuration of filter material and impermeable material. In a bilayer system, a permeable layer with several openings is attached to the filter material such that when air flows from the impermeable layer to the filter material, a space is created to allow air to flow readily through the filter material. When air flows from the filter material to the impermeable material without such a space, the filter material lays flat against the impermeable material, reducing the area of filter material that allows air to pass, thus restricting airflow.

The inhalation and exhalation valve regions can overlap partially or completely. Some include both valves at the base of the respiratory mask leading to the same filter material. Inhalation and exhalation regions are placed in many locations around the hood, can be of any size, and can be made from a wide range of filter materials. Material selection is dependent upon level of protection required, and size dependent upon air resistance of material. The inlet/inhalation and outlet/exhalation regions can be located anywhere on the hood, for example, over the ears so the airflow from inspiration can cool the user, or they can be integrated into the face shield to provide some rigidity.

Some embodiments include an interlocking mechanism between the respiratory mask and the hood that creates a protected respiratory pathway. Some embodiments include a clear face mask that does not obstruct user's face or limit field of view. Some embodiments include a check valve constructed from bilayer of filter material and impermeable material. Some embodiments include a structured filter material and impermeable material that create directed air valves with high surface area for air transfer. Some embodiments include an isolated exhalation pathway integrated into the face shield without obstructing view of the user's face. Some embodiments include integrated elastic bands that apply tension when a rear zipper is closed but not when the zipper is open. Some embodiments include integrated inlet valves that are located away from the nose and mouth so the lower protective quality of material is not covering high risk areas.

Figure 7:
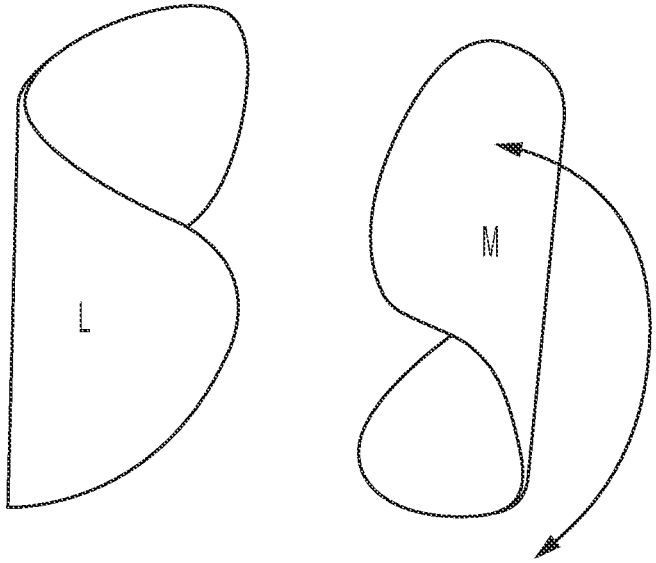
FIG. 7 is a schematic of a shape memory face shield.

Some embodiments of the invention include a "Shape Memory Face Shield." FIG. 7 shows a "Shape Memory Face Shield." In such an embodiment a face shield is trained to curl along a horizontal axis [M]. When worn, it curls along the vertical axis [L]. As the hood is doffed, the face shield curls along the horizontal axis away from the body to pull the contaminated edges away from the skin. The curling also encourages the hood to fall forward. The back edge of the hood often contacts the user's head during the doffing process. The curling face mask and a rear seam can eliminate this as a potential source of contamination.

Figure 8:
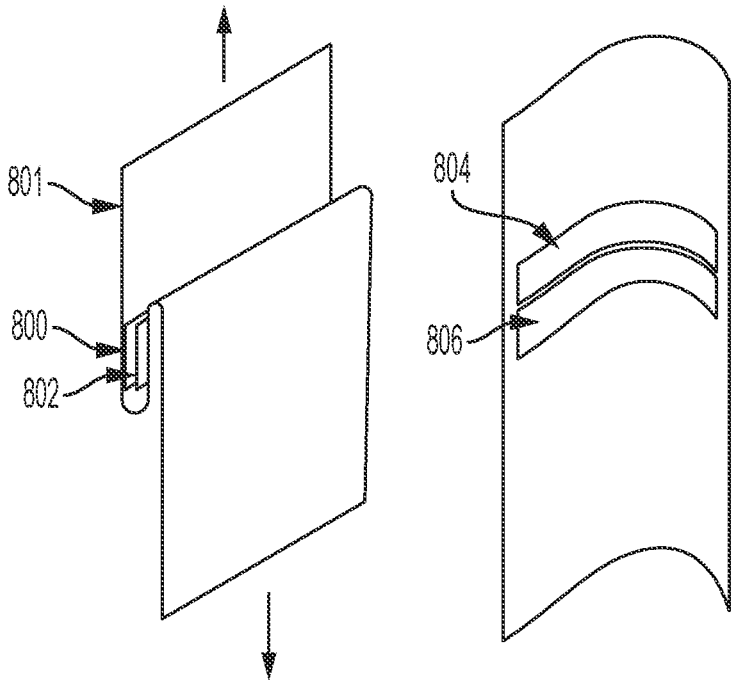
FIG. 8 is a schematic of a user-activated curling fabric.

Some embodiments of the current invention include a user activated curling fabric. FIG. 8 is an illustration of a user activated curling fabric. In such an embodiment, a piece of material that is trained to curl in one direction 800 (e.g. film, plastic sheet, single rib of plastic, etc.) is applied to the surface of a flexible substrate (fabric) 801. A second piece of material the same as the first 802 is applied opposing the force of the first curled piece. When the fabric is put under tension, these two curling supports separate 804, 806. As a result, the flexible substrate takes the shape of the material ribs.

Figure 9:
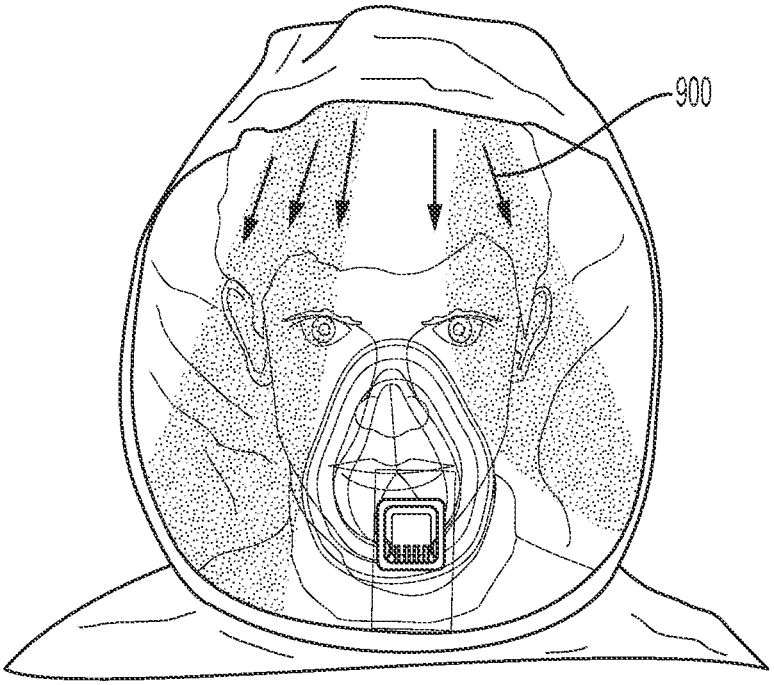
FIG. 9 shows a picture of a headset according to an embodiment of the invention.

Some embodiments include a body suit and headset with a desiccant fabric. In such an embodiment, desiccant is laminated between a vapor permeable membrane and a non-permeable membrane. FIG. 9 shows a body suit and headset with a desiccant fabric where vapor is pulled from the body suit interior into desiccant, pulling heat from the semi-permeable side of material. This causes the desiccant to heat up. The heat is transferred to the environment through the non-permeable membrane. When made into a contiguous material, this provides full body cooling to the user in personal protective equipment (PPE) and allows for dry air 900 to enter the headset.

Figure 10A:
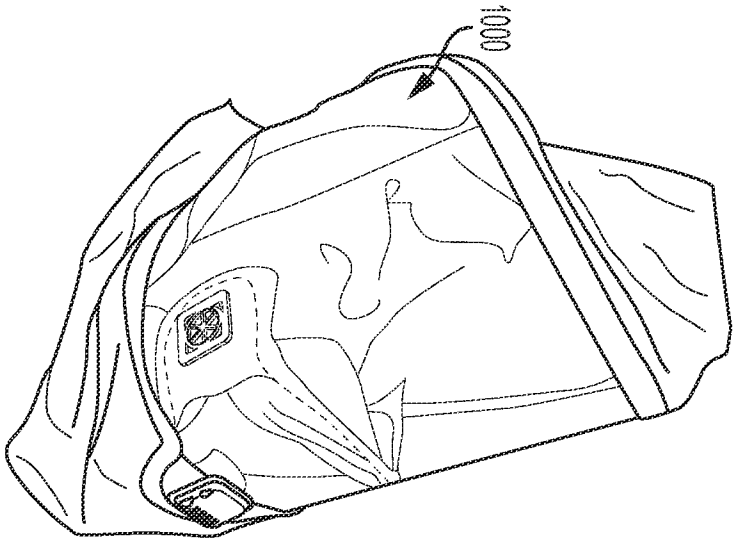
FIG. 10A-10B show a picture of a headset with water-resistant flaps positioned over the air inlets.
Figure 10B:
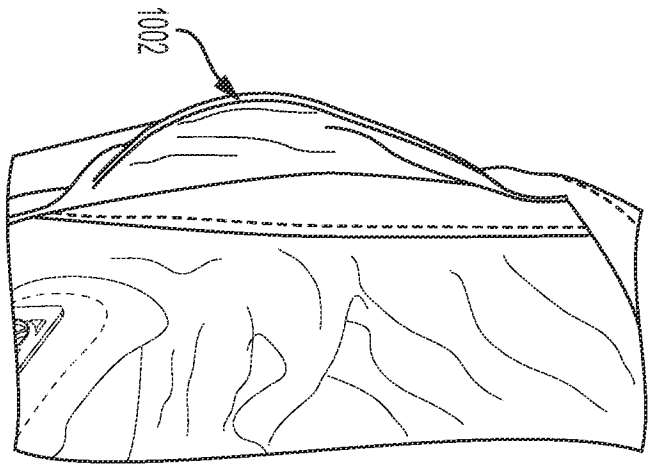

FIGS. 10A and 10B show a headset with waterproof flaps positioned over the air inlets. FIG. 10A shows a headset with a waterproof flap 1000 made of TYCHEM/TYVEK™. This waterproof flap allows for airflow while deflecting water. FIG. 10B shows the same headset of FIG. 10A with a lightweight metal strip 1002 integrated in the water flap. The lightweight metal strip allows for the waterproof flap to bow outward.

Figure 11A:
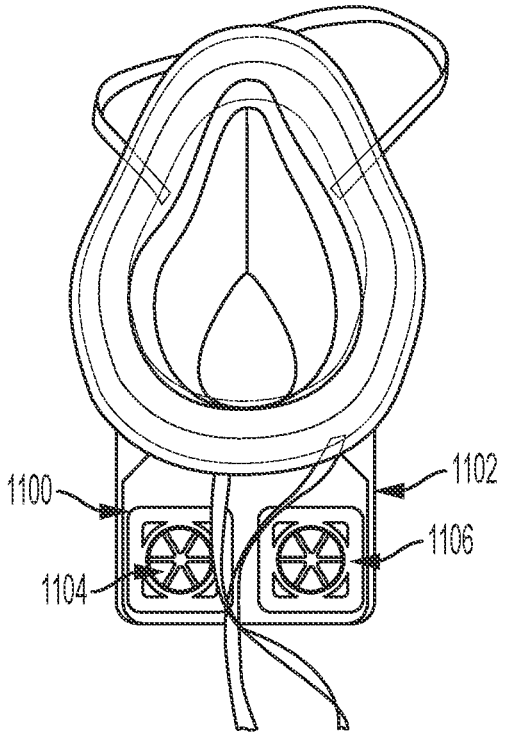
FIG. 11A-11D show pictures of example respiratory masks.
Figure 11B:
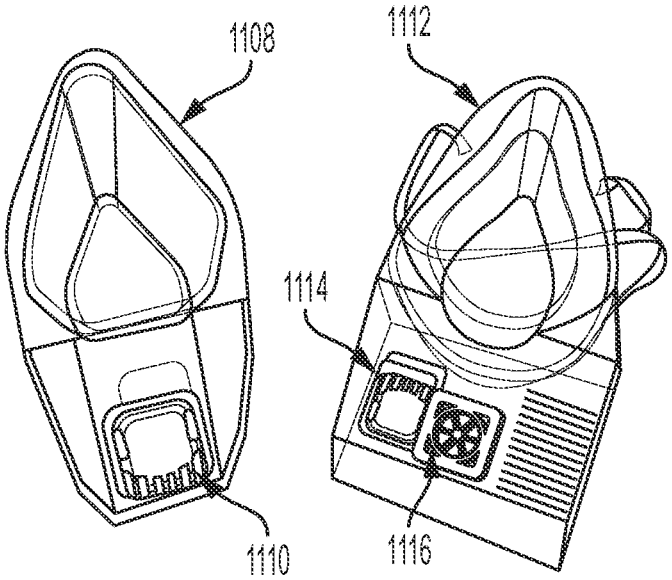
Figure 11C:
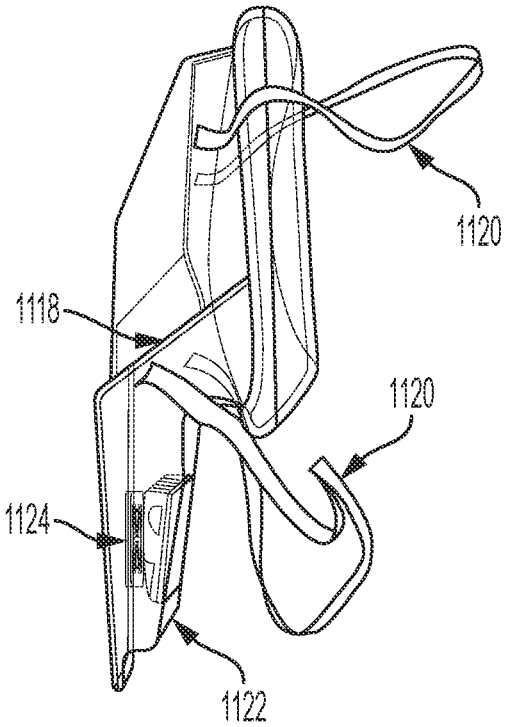
Figure 11D:
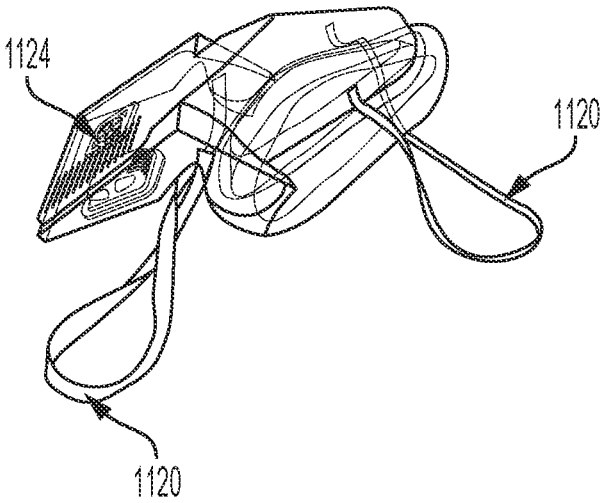

FIGS. 11A-11D show respiratory masks according to some embodiments. FIG. 11A shows a clear respiratory mask with a two inhalation valves 1100, 1102 each comprising one RADNOR™ one-way valve 1104, 1106. FIG. 11B shows two clear respiratory masks with slightly different features. The clear respiratory mask on the left is made of a plastic polymer such as polyethylene terephthalate (PETG) and the seal is made of silicone to make a tight seal 1108 and an exhalation valve on the front 1110. The clear respiratory mask on the left has an inflated face seal 1112, two inhalation valves on the back, 1114 and one exhalation valve on the front 1116. FIG. 11C shows a side view of a clear respiratory mask made with two pieces of vacuum formed PETG bonded together at a seam 1118, elastic bands 1120 for attaching the mask to the hood, two inhalation valves at the back 1122 and one exhalation valve on the front, 1124.

Figure 12A:
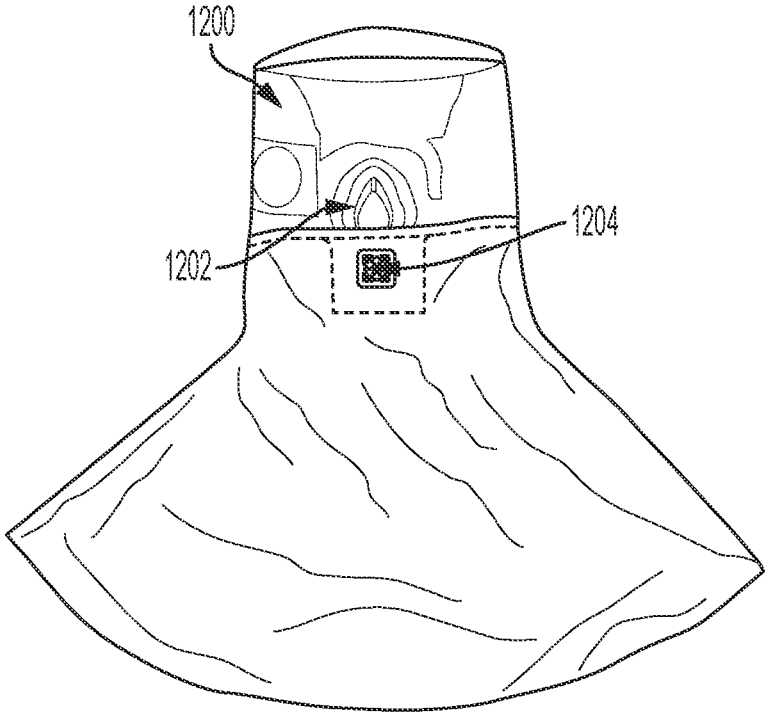
FIG. 12A-12B show pictures of example headsets.
Figure 12B:
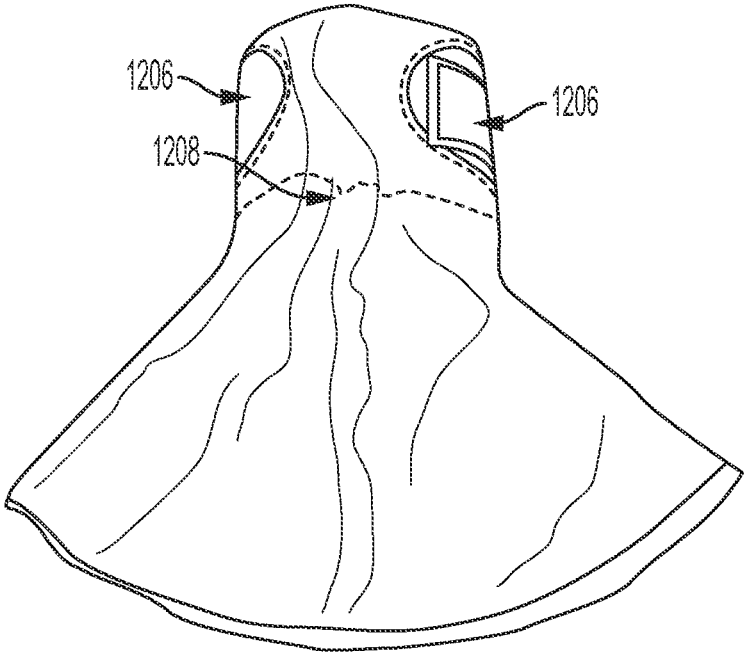

FIG. 12A and FIG. 12B show front and back views, respectively, of a headset according to an embodiment of the invention. FIG. 12A shows a headset comprising a large, clear face shield 1200, a respiratory mask visible behind the face shield 1202, and an exhalation valve 1204. FIG. 12B shows a rear-view of the headset of FIG. 12A with two air inlets in the form of inhalation filters 1206 and elastic sewn into the hood 1208 to secure the respiratory mask. The inhalation filters have a high surface area for air transfer.

Figure 13:
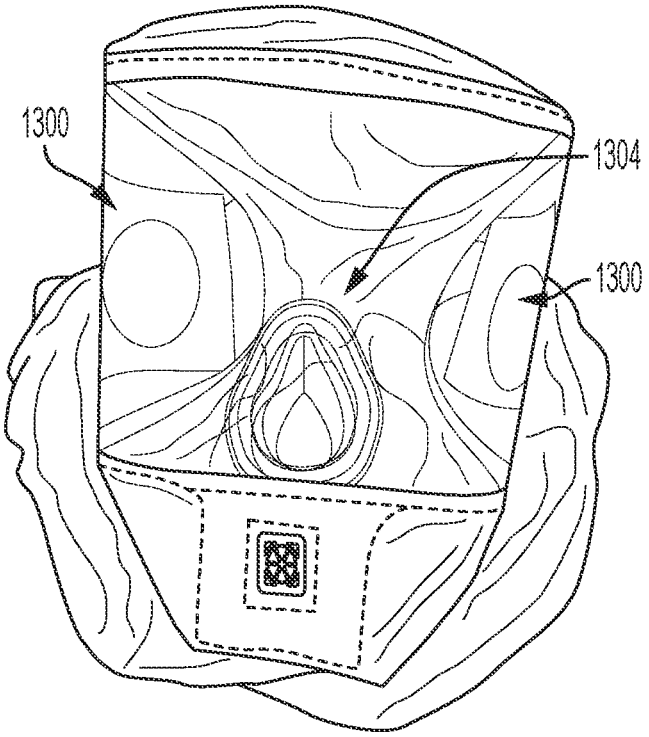
FIG. 13 is a picture of an example headset.
Figure 14:
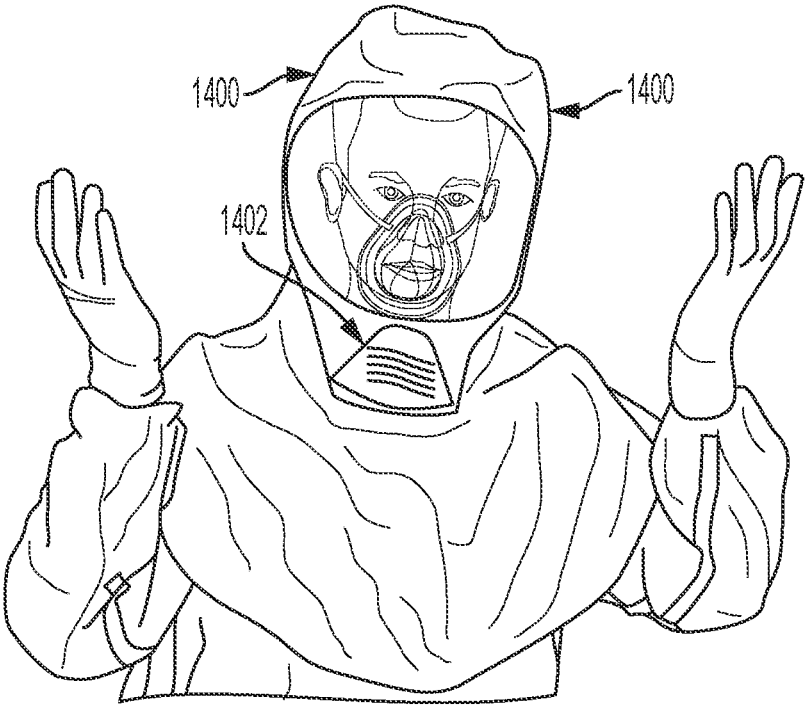
FIG. 14 is a picture of an example headset as worn by a user.
Figure 15A:
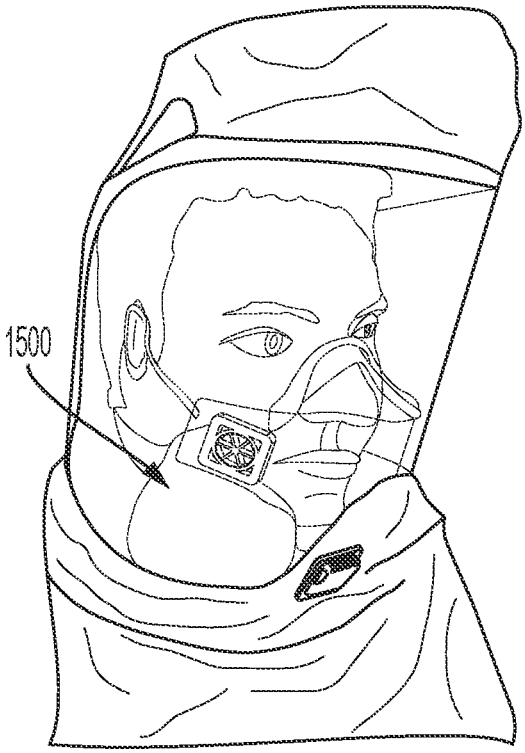
FIG. 15A is a picture of an example headset with a circumferential shroud, viewed from an angle.
Figure 15B:
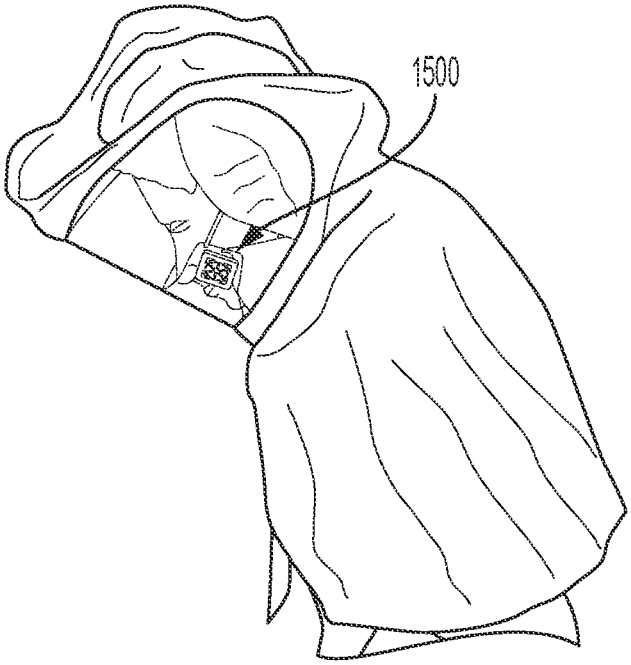
FIG. 15B is a picture of an example headset with a circumferential shroud, viewed from the side.

FIG. 13 shows an alternative headset with inhalation filters 1300 and elastic bands from the respiratory mask sewn into the hood 1304 according to an embodiment of the invention. FIG. 14 shows a headset with an inhalation filter 1400 and an air outlet in the form of an exhalation filter 1402 as worn by a user according to an embodiment of the invention. FIG. 15A and FIG. 15B show a headset with a circumferential shroud 1500 attached to the respiratory mask according to an embodiment of the invention. This shroud prevents air from entering the headset from beneath and makes a barrier between the head and body of a wearer. The inhalation filters have a high surface area for air transfer.

In some embodiments of the invention, the position of inhale/exhale valves allows for defogging of the face shield and hood as well as offers low resistance breathing. Foam on the respiratory mask stiffens the top of the mask and allows for one-size-fits-all without need for a metal bar. A clear plastic front on the mask allows for others to see the mouth of a wearer and allows for increased recognition of a wearer. In some embodiments, the mask is integrated into the hood, while in other embodiments the mask remains detachable. Inhalation valves on the mask are visible through the hood, making it easier to determine if they get blocked or aren't working. A valve shield prevents face from blocking inlet valves.

Some embodiments of the invention include a hood with a flat pack one size fits all respiratory mask. In such embodiments, inhale valves are located inside the hood and air is filtered prior to reaching the valves. Exhale valves are located outside the hood and decrease air recycling in the hood. The respiratory mask is sewn into the hood by elastic bands to secure it during donning and doffing. To create a barrier between the head of a wearer and the body, a fabric for the bottom half of the mask prevents air circulation between body and head. Inlet filters are positioned over the ear of a wearer for better hearing ability. A flap over the inlet filter with a lightweight metal strip for shape decreases the risk of fluids reaching the filter. A large clear face shield increases visibility and recognition of wearer.

In such an embodiment, the flat pack mask includes valves for clean and directed breathing, and is made with clear plastic for visibility. The mask allows for passive cooling and air circulation. Clear plastic allows others to see the wearer's face and the wearer to have a greater range of vision (competing masks limit the bottom 30 to 45 degrees of vision, while the instant embodiment is made with clear plastic on the top and front, allowing the wearer to see with an increased range). The inhale valves are located on the sides of the mask so fresh air flows over the plastic, reducing and clearing any fogging from the previous exhale. The inhale valves are on the sides of the mask and the exhale valve is on the bottom, so that none of the valves block the view of the wearer's mouth. Elastic bands for fixing the mask onto the wearer can go either around the head or around the ears of a wearer. When the bands are around the head, a bottom band that goes around the neck can be sewn into the hood to create a barrier between the head and the body, preventing air from circulating between the two and forcing fresh air to enter the hood with each inhale.

Having the elastic bands from the respiratory mask sewn into the hood improves ease of doffing, as the hood and respiratory mask are then donned and doffed as one piece. This also helps keep the elastic from slipping and causing the wearer discomfort.

To prevent fogging of the clear respiratory mask, inhale and exhale valves are incorporated with the clear respiratory mask so that fresh air flows in and exhaled air flows out. The inflow of fresh air clears any fogging that accumulated during the previous exhale. Inhale valves can be placed at edge of clear respiratory mask (away from mouth) and/or opposite each other (on left and right, top and bottom, etc. of mask) to increase area affected by flow.

In some embodiments, the respiratory mask is made of one piece of flexible, or specially folded, or otherwise conformable material (e.g. 0.01 inch thick polycarbonate material) extending from the front of the respiratory mask to anywhere between the tip of the nose and the base of the eyes, so that it conforms to the nose and cheeks. One piece of flexible, or specially folded, or otherwise conformable material extends from the front of the respiratory mask to below the chin (TYVEK™ or foam in our prototypes), so that it conforms to the bottom of the wearer's face/chin.

In some embodiments, a compressible material (such as foam) is used over the nose area, under the chin, and/or on any surface that comes in contact with the wearer's skin. The material then compresses over any raised areas (such as the ridge of the nose) and stays expanded over any indented areas (such as the intersection of nose and cheek), so that the respiratory mask conforms to the wearer's unique facial structure. This also creates a seal between the respiratory mask and skin. The respiratory mask creates a seal with the wearer's face.

In some embodiments, the respiratory mask is made so that it is secured to the face by any number of elastic bands extending from the right to the left side of the respiratory mask and that wraps around the back of the head or neck. The bottom-most band, i.e. the band secured closest to the bottom of the respiratory mask, may be secured into a sleeve that extends and is then secured to the hood. This creates a shroud, extending from the elastic at the back of the head or neck to the circumference of the hood, separating the volume within the hood that surrounds the head from the environment, the body, or elsewhere below the hood, preventing unfiltered or unwanted air from entering under the hood.

Some embodiments also include a vacuum formed respiratory mask. In such an embodiment, the position of the inhale/exhale valves allows for defogging the respiratory mask and hood. A clear plastic body allows for visibility and identification of wearer. A silicone face seal or inflated face seal ensures a good fit and seal.

Some embodiments also include a hood with a vacuum formed respiratory mask. In such an embodiment, inhale valves inside hood allow for air filtration prior to reaching valves. Exhale valve outside the hood allow for decreased air recycling in the hood. A respiratory mask is sewn into the hood with elastic bands. To create a barrier between the head of a wearer and the body, a fabric for the bottom half of the respiratory mask prevents air circulation between body and head. Inhalation filters are positioned over the ear of a wearer for better hearing ability. A flap over the inhalation filter with a lightweight metal strip for shape decreases the risk of fluids reaching the filter. A large clear face shield increases visibility and recognition of wearer. Some embodiments of the face shield allow for between 180-270 degree ranges of view.

Some embodiments include an interlocking mechanism in the form of a clipping mechanism for respiratory mask attachment to the hood. In such an embodiment, the clipping mechanism is an attachment that allows the respiratory mask to easily clip into and out of the hood. This mechanism includes a disk that a one-way valve from the respiratory mask secures into, and a U-shaped holder that is attached to the hood. The disk clips snuggly into the U-shaped holder, creating a firm connection between the hood and mask. The U-shaped holder can be attached to the hood so that the opening to the track along which the valve piece slides is at the bottom. This allows the wearer to doff the hood with the respiratory mask still on their face, as the holder would slide over and off the valve piece.

Figure 16A:
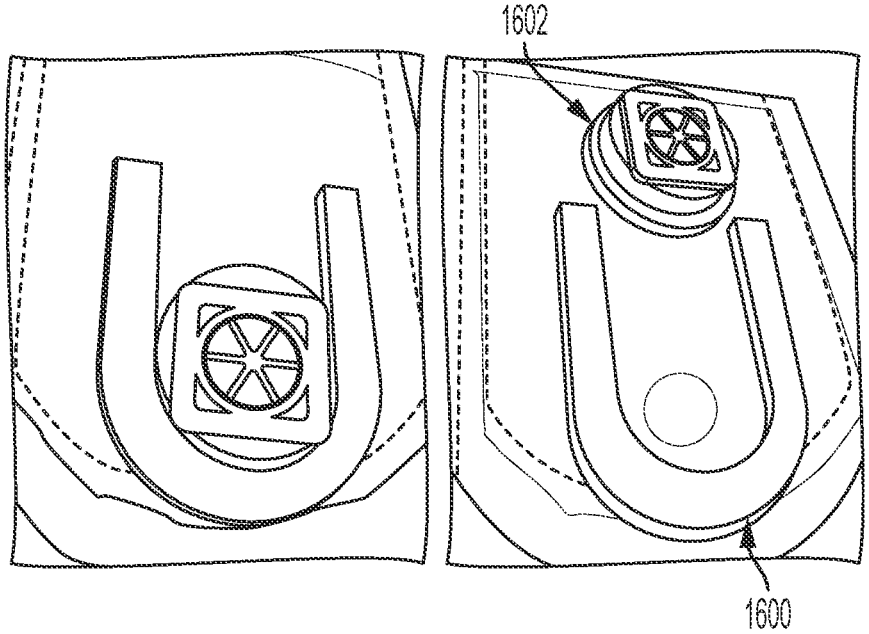
FIG. 16A is a picture of a clipping mechanism.
Figure 16B:
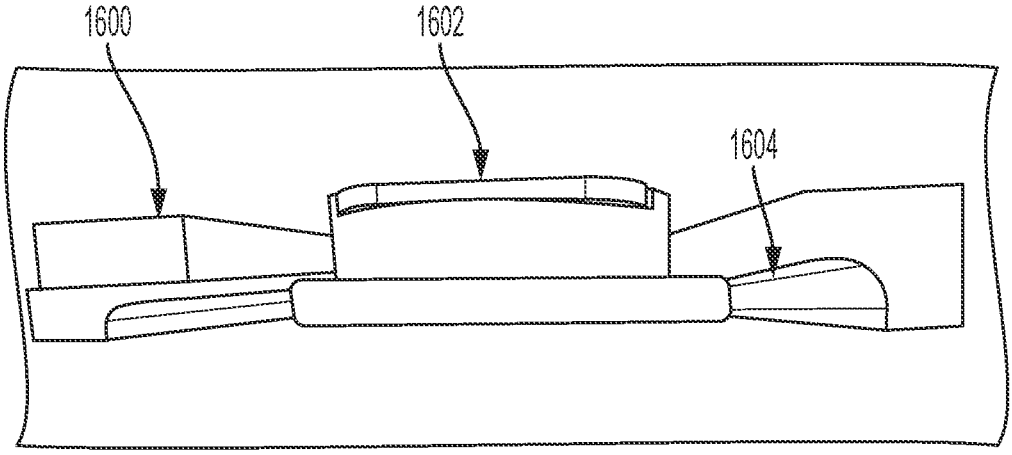
FIG. 16B shows a top view of the clipping mechanism from FIG. 16A.

FIG. 16A is a picture of the clipping mechanism. FIG. 16A shows a receiving end 1600 configured to allow a disk 1602 to slide in for attachment of the respiratory mask (left panel) and slide out for removal of the respiratory mask (right panel). FIG. 16B shows a top view of the clipping mechanism. In FIG. 16B, the disk 1602 slides into a track 1604 disposed into the receiving end 1600. This clipping mechanism creates a protected respiratory pathway between the mask and hood.

Alternatively, the U-shaped holder can be attached to the hood so that the opening is at the top. This would allow the wearer to tug at the bottom of the hood to unlock the valve from the holder, then doff the hood while leaving the mask attached.

Some embodiments include PPE ensemble configurations. Such embodiments include a hoodless coverall with the breakaway seam in the back for suit removal and a zipper in the front for easy donning Such embodiments can also include a hood with adhesive underneath the front edge so that the suit is applied in two pieces and doffed in a single piece.

Some embodiments include a personal protective whole-body suit, having a body portion and an unpowered respiratory protective headset connectable to the body portion to prevent infectious agents or contaminated air from entering the whole-body suit and/or headset. The headset has a respiratory mask. The respiratory mask has a flexible mask body having an interface section and defining a mask air inlet and a mask air outlet. The interface section is of a size, shape and material sufficient to form an air-tight seal around a nose and a mouth of a subject when worn. An inhalation valve is disposed in the mask air inlet and an exhalation valve disposed in the mask air outlet. The headset also has a hood having a hood body and a transparent face shield attached to the hood body. The hood is of a sufficient size and shape to be worn entirely over and enclose the subject's head and the respiratory mask while the subject is wearing the respiratory mask within the hood. The hood defines an air inlet and an air outlet spaced apart from the air inlet. The hood further has an inlet filter disposed in the air inlet and an outlet valve disposed in the air outlet. In some embodiments, the hood further has an inlet valve disposed in the air inlet and an outlet valve disposed in the air outlet. The air inlet, the mask air inlet, the mask air outlet and said air outlet are configured relative to each other to direct air flow across an inner surface of the transparent face shield to prevent or reduce fogging of the transparent face shield during inhalation and exhalation by the subject when the unpowered respiratory protective hood is worn. Also, the mask air outlet is attachable to and detachable from the air outlet.

Table 1 provides a list of some features of embodiments of the invention. The list of features is not comprehensive.

TABLE 1

List of headset features

| Feature | Description | Function |
|---|---|---|
| Integrated hood | Creates seamless, impermeable barrier to cover face, and is removed in one step along with the rest of the suit | Improves ease of doffing |
| Unpowered respiratory headset with hood, hood body and large transparent face shield | Hood with passive cooling features and large visor for improved visibility of and for the HCW | Improves visibility |
| Unpowered respiratory headset with integrated inlet filters or inlet valves | Pulls less saturated air in from the environment over the inside of the visor when the user inhales | Improves comfort |
| Face shield with clear face mask- integrated/disposable | Clear face mask (so that clinician's mouth is visible), with inhale and exhale vales to direct airflow and reduce fogging | Improves visibility and comfort |
| Clear face mask- reusable | Clear face mask (so that clinician's mouth is visible), with inhale and exhale valves to direct airflow and reduce fogging. Mask is not integrated into hood | Improves visibility and comfort |
| Isolated exhalation pathway valves | Directs air out the bottom of the hood using the same one way valves used in standard N95 respirator masks. This keeps the hot moist air away from the visor | Improves comfort |
| Inhale/Exhale Valves | 2 inhale valves on either side of front of mask, 1 or 2 exhale valves located at the base of the mask | Defog mask and hood, low resistance |
| Foam Nose Piece | Foam lines top of mask to stiffen surface | Keeps mask from folding over, fits face without metal bar |
| Clear Mask Window | Front surface of mask is clear plastic, can be bonded to hood shield | Increase recognition of wearer; can build mask and hood as one piece |
| Visible Valves | Valves visible through hood | Can easily see if valves get blocked or aren't working |
| Valve Shield | Placement of valve cover on inside of mask for exhale valve | Prevent mask fabric from blocking valves |
| Ear Loops | Elastic around ears instead of around head, attached to mask | Easier to don than around-the-head elastic; adjustable elastic length through staples |
| Bottom-Fabric Neck Circumferential Shroud | Bottom fabric of mask can extend to make shroud around neck | Seals head from rest of body, potential for hood to be respirator |
| Elastic attachment of mask to back of the hood | Elastic from mask sewing into hood | Better fit and easier doffing |

The embodiments illustrated and discussed in this specification are intended only to teach those skilled in the art how to make and use the invention. In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the expressly described embodiments can be configured without departing from the scope of the invention. The illustrated embodiments has been set forth to facilitate the explanation of some concepts of the current invention and should not be taken as limiting the invention. Therefore, it is to be understood that, within the scope of the appended claims, the invention may be practiced other than as specifically described herein.

We claim:

1. An unpowered respiratory protective headset for personal protective equipment, comprising:

a respiratory mask, comprising:

a flexible mask body having an interface section and defining a mask air inlet and a mask air outlet, said interface section being of a size, shape and material to form an air-tight seal around a nose and a mouth of a subject when worn;

an inhalation valve disposed in said mask air inlet; and an exhalation valve disposed in said mask air outlet; and a hood comprising a hood body and a transparent face shield attached to said hood body, said hood being of a size and shape to be worn entirely over and enclose said subject's head and said respiratory mask while said subject is wearing said respiratory mask within said hood, wherein said hood defines an air inlet and an air outlet spaced apart from said air inlet, wherein said hood further comprises an inlet filter disposed in said air inlet and an outlet valve disposed in said air outlet, wherein said air inlet, said mask air inlet, said mask air outlet and said air outlet are configured relative to each other to direct air flow across an inner surface of said transparent face shield to prevent or reduce fogging of said transparent face shield during inhalation and exhalation by said subject when said unpowered respiratory protective headset is worn, wherein said mask air outlet is at least one of attachable to and detachable from said air outlet or said mask air outlet is permanently attached to said air outlet, wherein said transparent face shield has a top that extends beyond said subject's forehead and a bottom that extends beyond said subject's chin when said hood is worn by said subject, and wherein said air inlet of said hood is one of arranged proximate to or through said top of said transparent face shield and said air outlet of said hood is one of arranged proximate to or through said bottom of said transparent face shield such that, while in use, air flows into said hood through said air inlet of said hood and flows across said inner surface of said transparent face shield before reaching said respiratory mask.

2. The unpowered respiratory protective headset of claim 1, wherein said air inlet has said inlet filter with undulations in a filter sheet to increase surface area and further comprising a multilayer configuration of a filter material and an impermeable material.

3. The unpowered respiratory protective headset of claim 1, wherein said air inlet is disposed on a region corresponding to a top region of said hood.

4. The unpowered respiratory protective headset of claim 1, wherein said hood further comprises a water resistant flap disposed over said air inlet.

5. The unpowered respiratory protective headset of claim 1, wherein said transparent face shield is of dimensions and shape to allow for at least a 120 degree range of view.

6. The unpowered respiratory protective headset of claim 1, wherein said inhalation valve comprises a one-way valve configured to direct air to flow into an interior space of said respiratory mask.

7. The unpowered respiratory protective headset of claim 6, wherein said one-way valve comprises a multilayer configuration of a filter material and an impermeable material.

8. The unpowered respiratory protective headset of claim 1, wherein said exhalation valve comprises a check valve configured to direct air to flow out from an interior space of said respiratory mask.

9. The unpowered respiratory protective headset of claim 8, wherein said check valve comprises a multilayer configuration of a filter material and an impermeable material.

10. The unpowered respiratory protective headset of claim 1, wherein said mask air outlet is attachable to and detachable from said air outlet by at least one of an interlocking system or hook and loop fasteners, and wherein said interlocking system or hook and loop fasteners are configured to create a protected respiratory pathway between said respiratory mask and said hood.

11. The unpowered respiratory protective headset of claim 10, wherein said interlocking system is a clipping mechanism comprising:

a disk disposed onto said air mask outlet; and a receiving end for said disk disposed onto said transparent face shield, wherein said receiving end is configured to allow said disk to slide into said receiving end when attaching said respiratory mask to said hood and to slide out from said receiving end when removing said respiratory mask from said hood.

12. The unpowered respiratory protective headset of claim 1, wherein said mask air outlet is permanently attached to said air outlet.

13. The unpowered respiratory protective headset of claim 1, wherein at least a portion of said flexible mask body comprises one or more filter layers.

14. The unpowered respiratory protective headset of claim 1, wherein at least a portion of said flexible mask body is transparent.

15. The unpowered respiratory protective headset of claim 1, wherein said respiratory mask further comprises a plurality of straps, said plurality of straps each comprising a first end point and a second end point, wherein said first end point is attached to said flexible mask body at a first attachment point and wherein said second end point is attached to said flexible mask body at a second attachment point.

16. The unpowered respiratory protective headset of claim 1, wherein said respiratory mask further comprises a plurality of straps, said plurality of straps each comprising a first end point and a second end point, wherein said first end point is attached to said flexible mask body at a first attachment point and wherein said second end point is attached to an interior surface of said hood body at a second attachment point.

17. The unpowered respiratory protective headset of claim 1, further comprising a circumferential shroud attached to at least a portion of a lower edge of said flexible mask body, and wherein said circumferential shroud prevents air from entering said unpowered respiratory protective headset from a base of said unpowered respiratory protective headset.

18. A personal protective whole-body suit, comprising:

a body portion; and an unpowered respiratory protective headset connectable to said body portion to prevent infectious agents or contaminated air from entering there between, comprising:

a respiratory mask, comprising:

a flexible mask body having an interface section and defining a mask air inlet and a mask air outlet, said interface section being of a size, shape and material to form an air-tight seal around a nose and a mouth of a subject when worn;

an inhalation valve disposed in said mask air inlet; and an exhalation valve disposed in said mask air outlet; and a hood comprising a hood body and a transparent face shield attached to said hood body, said hood being of a size and shape to be worn entirely over and enclose said subject's head and said respiratory mask while said subject is wearing said respiratory mask within said hood, wherein said hood defines an air inlet and an air outlet spaced apart from said air inlet, wherein said hood further comprises an inlet filter disposed in said air inlet and an outlet valve disposed in said air outlet, wherein said air inlet, said mask air inlet, said mask air outlet and said air outlet are configured relative to each other to direct air flow across an inner surface of said transparent face shield to prevent or reduce fogging of said transparent face shield during inhalation and exhalation by said subject when said unpowered respiratory protective headset is worn, wherein said mask air outlet is attachable to and detachable from said air outlet, wherein said transparent face shield has a top that extends beyond said subject's forehead and a bottom that extends beyond said subject's chin when said hood is worn by said subject, and wherein said air inlet of said hood is one of arranged proximate to or through said top of said transparent face shield and said air outlet of said hood is one of arranged proximate to or through said bottom of said transparent face shield such that, while in use, air flows into said hood through said air inlet of said hood and flows across said inner surface of said transparent face shield before reaching said respiratory mask.

* * * * *